US005759111A

United States Patent [19]

Clark

[11] Patent Number: 5,759,111

[45] Date of Patent: Jun. 2, 1998

[54] SINGLE TINE DIVOT REPAIR TOOL

[76] Inventor: William A. Clark, 5 Deerfield Pl., Trabuco Canyon, Calif. 92679

[21] Appl. No.: 766,692

[22] Filed: Dec. 13, 1996

[51] Int. Cl.[6] ..... A63B 57/00

[52] U.S. Cl. ..... 473/285; 473/286

[58] Field of Search ..... 473/282–286, 473/300–303; 172/371

[56] References Cited

U.S. PATENT DOCUMENTS

| | | | |
|---|---|---|---|
| 167,745 | 9/1875 | Cowles | 30/164.5 |
| 2,112,649 | 3/1938 | Dreyfuss | 30/164.5 |
| 2,609,851 | 9/1952 | Hadfield | 81/489 |
| 4,819,939 | 4/1989 | Kobayashi | 473/300 |
| 4,822,052 | 4/1989 | Dimmick | 473/285 |
| 4,957,293 | 9/1990 | Byrd | 473/285 |

FOREIGN PATENT DOCUMENTS 2128485 5/1984 United Kingdom .

*Primary Examiner*—Sebastiano Passaniti
*Assistant Examiner*—Stephen L. Blau

[57] ABSTRACT

An improved golf ball divot tool. A single spike fits into the vent hole of the putter grip which surrounds the upper end of the shaft. The divot tool is a body having a first end portion tapered to a point, and a second end portion fixed with a knob. The first end portion is guided into the putter grip vent hole and pushed downward until the knob touches the putter grip. This location readies the tool for use on the green. The tool is removed from this stored position by pulling on the knob. The pointed end is used to penetrate the soil or turf and repair the damage caused by the ball impacting the green. Extra leverage provided by the elongated divot tool surpasses prior art applications.

1 Claim, 1 Drawing Sheet

SINGLE TINE DIVOT REPAIR TOOL

FIELD OF THE MENTION

This invention relates to an improved divot repair tool. A single spike that fits into the putter handle vent hole.

BACKGROUND OF THE INVENTION

When a golf ball strikes a putting surface, irregularities are cause by the impact. This happens during the course of play. It is the golfers responsibility to fix or mend these marks soon after they occur. The quicker they are repaired, the faster the green heals. A better, smoother putting surface results. This preserves the quality of the golf course for all subsequent players. A device is usually carried on a person or player to perform this function. If forgotten or left in the golf bag, this inconvenience will cause divot marks to go unfixed. In the prior art, divot repair tools are multiple tine devices that have a length of approximately 2 inches. These devices lack the optimum leverage to loosen the impacted dent created when the ball lands on the green at the termination of aerial flight from the fairway. This difficulty causes fewer divots to be repaired.

SUMMARY OF THE INVENTION

This invention is a single tine divot repair tool that can be inserted and retained by the putter grip vent hole. The tool is a single spike with a point on one end and a knob on the other end. The hollow end of the putter shaft is closed by the grip handle. The only opening is a small vent hole. This hole becomes the storage place for the divot tool. This convenient storage site assures that the required aid to fix putting green dents will not be forgotten. The unusually elongated shaft of the repair tool, provides exceptional leverage which makes mending greens quick and easy.

BRIEF DESCRIPTION OF THE INVENTION

DETAILED DESCRIPTION

Figure 1:
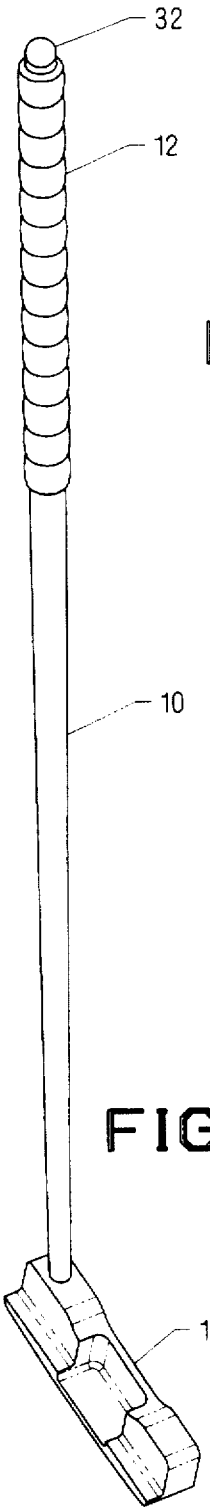
FIG. 1 is a perspective view of a putter with the invention added to the handle.
Figure 3:
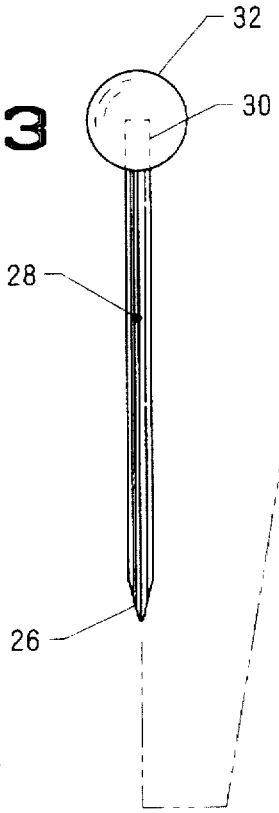
FIG. 3 is a side view of the divot tool.

FIG. 1 Illustrates the golf club 33 with the invention FIG. 3 inserted into the grip handle 12. A club is comprised of a shaft 10 having a head or ball striking surface 14 on one end and a second end portion 12 used for gripping by the golfer.

Figure 2:
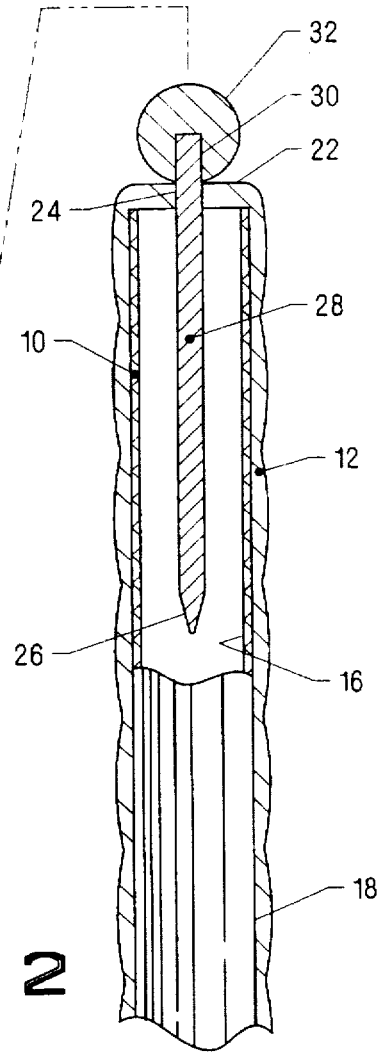
FIG. 2 is a view in cross section of the invention showing the divot tool as a unit inserted into the putter grip vent hole.

A divot device is shown in greater detail in FIGS. 2 and 3. A hollow club shaft has an inner surface 16 and an outer surface 18. A grip 12 is located on the outer surface 18 of the shaft. The most common grip design is of a one piece construction 12. When a shaft 10 is fitted with a grip 12, a vent hole 24 is necessary in order to break a vacuum which otherwise would be trapped within the club shaft 10. The grip 12 extends over the open end of the shaft at the second end 22. It is on this surface of the grip that a vent hole 24 is located.

A divot tool point 26 is guided into the putter vent hole 24 and the tool 28 is pushed downward until it is flush with the putter grip 22. This becomes the storage site for the divot tool. It is held in this position by friction.

The point is an integral structure to the elongated shaft 28 having at its lower end a surface leading to a point 26. This point 26 being approximately 60 degrees. The shaft of the divot tool 28 is approximately 4 inches long. This includes the part that is embedded into the knob 30. The shaft 28 is made of a rigid material. It may be formed of metal or other rigid materials as well as plastic. The thickness of the divot tool 28 is approximately 3/16 inches in diameter. The elongated shaft 28 can be round, square, hexangular, dihedral, trihedral or other geometric designs.

A knob 32 can be formed by a rigid, semi rigid or slightly resilient material such as rubber, plastic, wood or may be made of metal. The knob 32 functions as a device to withdraw the shaft of the divot tool 28 from the vent hole in the putter handle grip 24. The knob 32 is approximately 5/8 inches in diameter. It can be spherical, square, oblong, flat, rectangular or any shape that permits the divot tool shaft 28 to be withdrawn from the vent hole 24 in the putter handle grip 22.

I claim:

1. A golf green ball mark repair tool in combination with a golf grip comprising, said grip having a vent hole, said tool having a single tine shaft which is elongated with a point on one end and a knob on an opposite end, said shaft being 3/16 inch in diameter and 4 inches in length and able to fit into said vent hole of said grip, said shaft being non-tapered with the exception of said pointed end which is blunt and less than 2 percent of the length of said shaft, whereby the shaft can penetrate the turf while leaving a maximum thickness to move a surroundings of a divot hole, and said knob being 5/8 inch in diameter so that said tool can be removed from said grip vent hole with a thumb and a forefinger.

* * * * *